US007338262B2

(12) United States Patent
Gozdawa

(10) Patent No.: US 7,338,262 B2
(45) Date of Patent: Mar. 4, 2008

(54) DOWNHOLE COMPRESSOR

(75) Inventor: Richard Julius Gozdawa, Hillingdon (GB)

(73) Assignee: Corac Group PLC, Uxbridge, Middlesex (GB)

( * ) Notice: Subject to any disclaimer, the term of this patent is extended or adjusted under 35 U.S.C. 154(b) by 521 days.

(21) Appl. No.: 10/501,643

(22) PCT Filed: Jan. 15, 2003

(86) PCT No.: PCT/GB03/00149

§ 371 (c)(1),
(2), (4) Date: Jul. 15, 2004

(87) PCT Pub. No.: WO03/062644

PCT Pub. Date: Jul. 31, 2003

(65) Prior Publication Data

US 2005/0074344 A1 Apr. 7, 2005

(30) Foreign Application Priority Data

Jan. 16, 2002 (GB) ..... 0200864.7

(51) Int. Cl.
*F04D 25/02* (2006.01)
*F04D 5/00* (2006.01)

(52) U.S. Cl. ..... 417/423.8; 417/423.12; 417/424.1; 417/423.3; 417/366

(58) Field of Classification Search ..... 417/366, 417/423.7, 423.8, 423.12, 424.1, 423.3
See application file for complete search history.

(56) References Cited

U.S. PATENT DOCUMENTS 5,857,348 A * 1/1999 Conry ..... 62/209
2002/0011337 A1* 1/2002 Grant ..... 166/372

FOREIGN PATENT DOCUMENTS

GB 2362901 A * 12/2001

* cited by examiner

*Primary Examiner*—Anthony D. Stashick
*Assistant Examiner*—Leonard J Weinstein
(74) *Attorney, Agent, or Firm*—Jon A. Gibbons; Fleit Kain Gibbons Gutman Bongini & Bianco P.L.

(57) ABSTRACT

A downhole dynamic compressor comprises an electric motor having a stator 6 with stationary windings and an armature with permanent magnets 7 supported on gas bearings 9, 10 for rotation relative to the stator. The gas bearings 9 and 10 are arranged at the upstream and downstream opposite ends of the motor, respectively. The dynamic compressor has a bladed wheel 12 mounted on an overhanging end of the motor armature 7 that projects beyond the gas bearing 9 at the upstream end of the motor, whereby all the gas bearings of the compressor and the electric motor are arranged on the downstream side of the dynamic compressor.

20 Claims, 6 Drawing Sheets

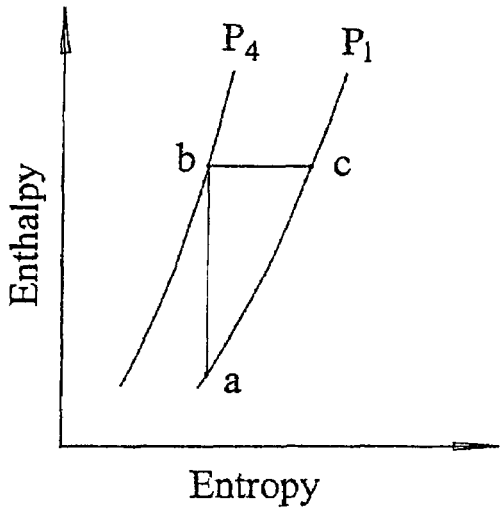
Fig. 5a
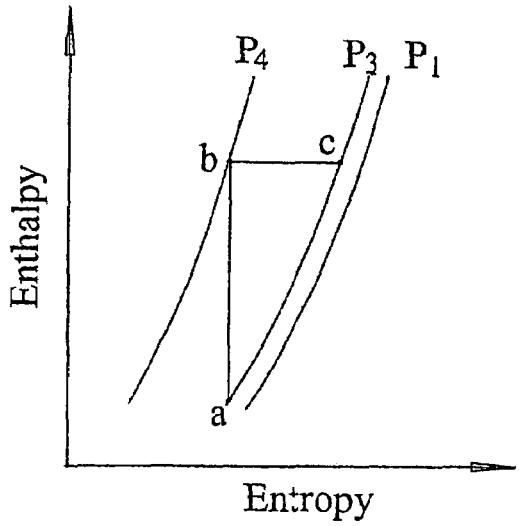
Fig. 5b
Fig. 6b
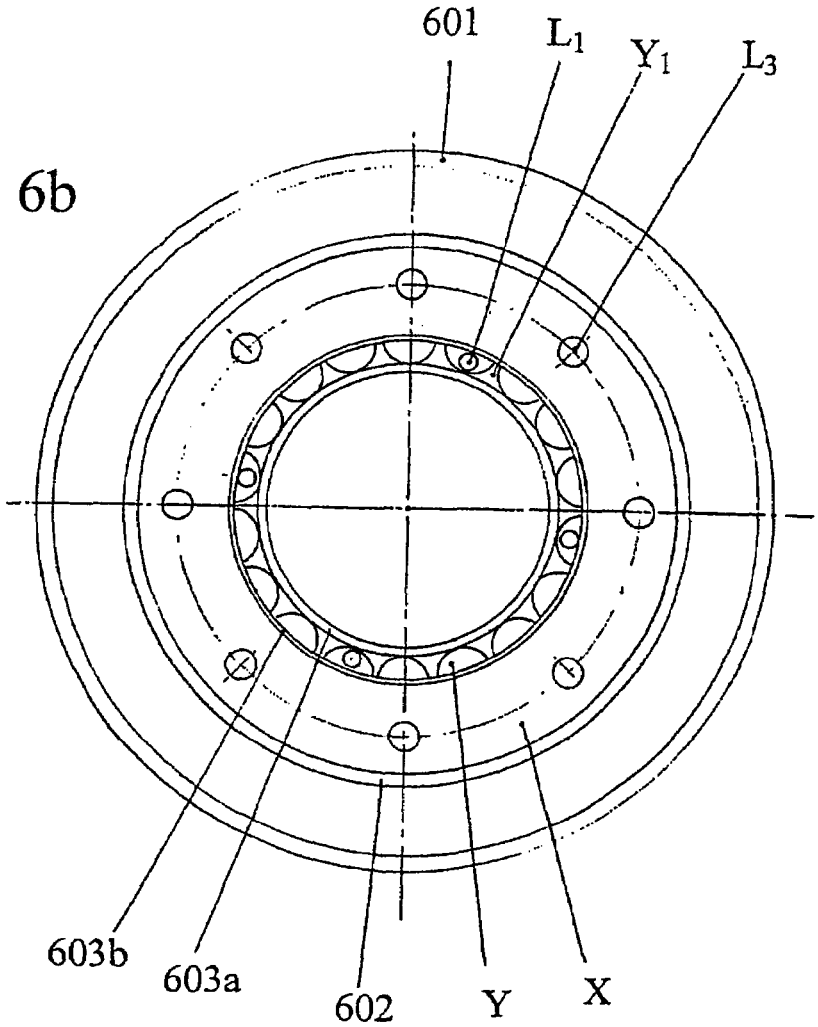

DOWNHOLE COMPRESSOR

CROSS-REFERENCE TO RELATED APPLICATIONS

This application is based upon and claims priority from PCT/GB03/00149, filed on Jan. 15, 2003, which is based on and claims priority from British Application 0200864.7 filed on Jan. 16, 2002, the entire disclosure of each of the aforementioned applications are each herein incorporated by reference in their entirety.

BACKGROUND OF THE INVENTION (1) Field of the Invention

The present invention generally relates a downhole compressor, and more specifically to a compressor designed to be lowered into a well of a natural gas reservoir to assist in extracting gas from the reservoir.

(2) Description of Related Art

It is known in the art that the gas flowing from a well drilled into a gas reservoir frequently carries with it a burden of vapor and liquid droplets. The pressure of gas at the base of a well falls as gas is extracted. Consequently the flow velocity of the gas in the production tubing also falls, and eventually becomes too low to carry its burden of condensed liquids. As a result, liquid accumulates at the base of the well, the gas flow falls and eventually ceases. Gas production ceases to be economically effective before the gas flow ceases and operators will normally abandon a well long before the gas supply is exhausted.

It has previously been proposed in the PCT patent application number WO97/33070 to install into the well an electrically or hydraulically powered gas compressor to rest at the bottom of the well. The effect of the compressor is to accelerate production and increase the ultimate recovery from the reservoir. In the first place, the compressor acts to reduce the static pressure at its inlet which increases the pressure difference between the reservoir and the well, so as to stimulate greater flow. Second, by increasing the gas pressure, the compressor increases the average density which leads to a reduction in flow velocity and hence in a reduction in the pressure losses along the length of the well. A further effect of the compression is to raise the temperature of the gas and thereby delay condensation of vapor.

Though the latter patent application discloses the concept of what is herein termed a downhole compressor, the compressor that it teaches has several limitations that would make it impracticable. For example, the electric motor used to drive the rotor shaft carrying the impellers that compress the produced gas is connected to the rotor shaft through gearing which allows the motor to rotate much more slowly than the impellers. This design is to enable the motor to be oil cooled and oil lubricated while air bearings are used to support the shaft carrying the impellers. However, this presents problems with the maintenance of the reduction gearing which are not addressed in the application. Furthermore, the application gives no details of how the gas bearings supporting the rotor shaft can be constructed or configured to receive an adequate supply of clean gas, nor does it resolve the rotor dynamic requirements of a shaft system supported on both gas and liquid lubricated bearings.

Accordingly, a need exists to provide a rotary compressor to overcome the above-mentioned limitations.

BRIEF SUMMARY OF THE INVENTION

The present invention provides a rotary compressor which is suitable for use as a downhole compressor in that its gas bearings can be operated over very prolonged periods without requiring attention and in that its electric motor is adequately cooled by the produced gas.

In accordance with a first embodiment of the present invention, there is provided a compressor designed to be lowered into a well of a natural gas reservoir to assist in extracting gas from the reservoir, the compressor comprising a casing, a rotor mounted within the casing, an electric motor for driving the rotor having a stator with windings stationarily mounted in the casing and an armature formed as part of the rotor, and gas bearings supporting the rotor for rotation relative to the stator, the gas bearing being arranged at the upstream and downstream opposite ends of the motor, characterized in that a bladed impeller wheel for compressing the production gas from the reservoir is mounted on an overhanging end of the rotor that projects beyond the gas bearing at one end of the motor, such that all the gas bearings of the compressor and of the electric motor are arranged on the same side of the bladed impeller wheel, and during operation, the production gas flows over and serves to cool the electric motor.

In the present invention, the bladed impeller wheel, herein also termed the main compressor, is overhung.

The design of the motor rotor with an overhung compressor permits the rotor to be made hollow so that it can be better cooled.

In a preferred embodiment of the invention, the main compressor is arranged at the upstream end of the rotor and an auxiliary compressor is mounted on the opposite end of the rotor, the auxiliary compressor drawing gas from downstream of the main compressor and serving to supply the gas after further pressurization to the bearings of the rotor.

In a second embodiment of the invention, both compressors can be overhung so that all the bearings are situated axially between the main and auxiliary compressors.

The auxiliary compressor may itself be an axial compressor or other type of dynamic compressor. The term "dynamic compressor" is used here to include rotary compressors that produce axial and/or radial flow and thus in particular includes both axial, mixed and centrifugal compressors.

It is envisaged that a purifier may be provided in the intake of the auxiliary compressor to remove particulates or other impurities suspended in the produced gas. The purifier may conveniently be an inertial separator.

In the preferred embodiment of the invention, the gas for the gas bearings flows in the opposite direction to the main axial gas flow of the produced gas. Though the gas can be discharged into the main flow of the produced gas after it has passed through the bearings, it is preferred to cool the gas by transferring heat from it to the main flow of produced gas, whereupon the gas can be recycled to the bearings by being returned to the intake of the auxiliary compressor. In this way, it is possible for the gas supplied to the gas bearings to flow essentially in a closed circuit.

When the gas supplied to the bearings flows in a closed circuit containing a purifier, the purifier does not have to be able to remove the particulate matter in all of the produced gas and it is therefore able to function reliably over prolonged periods of time. In this case the purifier may even be a simple filter.

Because in the present invention gas always enters and leaves the compressor axially, it is possible to use a modular approach in which a number of such compressor modules are close coupled (aerodynamically and electrically) in tandem. Furthermore modules, and/or a set of modules in tandem, may be disposed at various depths in the production tube of a well in order to optimize the upward movement of droplets and inhibit the condensation of vapor.

BRIEF DESCRIPTION OF THE DRAWINGS

The invention will now be described further, by way of example, with reference to the accompanying drawings, in which:

FIGS. 5*a* and 5*b* are idealized enthalpy-entropy diagrams that refer to the embodiments of FIGS. 3 and 4, FIG. 6*b* is a section through the compressor of FIG. 6*a* taken along the plane A-A in FIG. 6*a*.

DETAILED DESCRIPTION OF THE INVENTION

Figure 1:
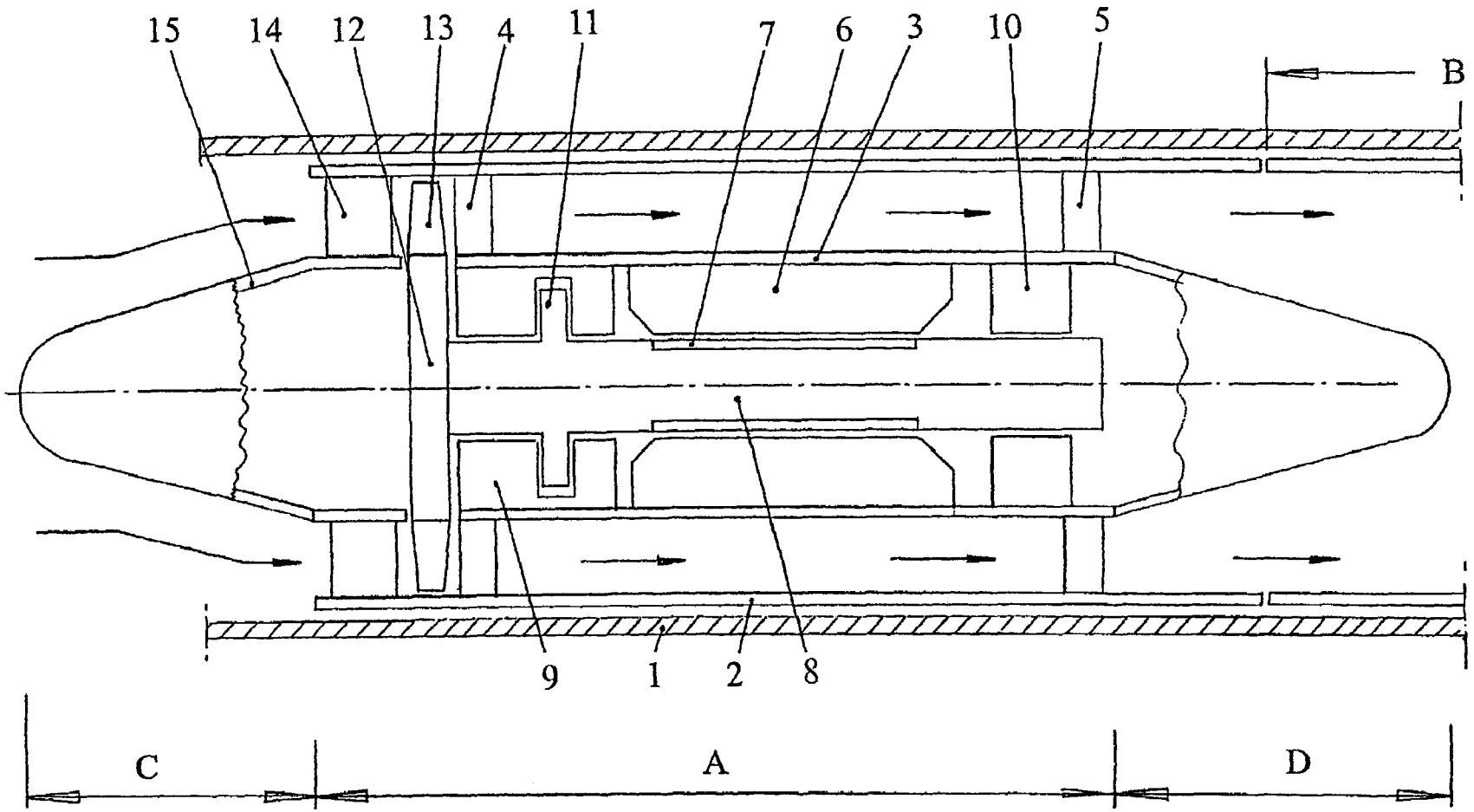
FIG. 1 is an axial section through a first embodiment of dynamic downhole compressor.

In FIG. 1, reference numeral 1 designates the production tube of a well, numeral 2 designates the outer shell of a compressor and numeral 3 refers to the casing of an electric motor. The casing of the motor is held concentrically within the shell of the compressor by the fixed blades 4 of the compressor and by the arms of a spider 5.

The motor is a high frequency induction motor and is supplied with high frequency current via an umbilical that is not shown in the Figure. Typically the speed of the motor is in the range of 20,000 rpm to 50,000 rpm. The preferred electric motor has a stator 6 and a permanent magnet armature or rotor 7 but it would be possible to use an alternative form of induction motor, such as a squirrel cage motor.

The rotor of the compressor, of which the armature of the motor forms a part, is designated 8. The rotor runs in journal bearings 9 and 10, and thrust is taken by a thrust bearing having a collar 11.

The motor drives the wheel 12 of the dynamic compressor which has a bladed impeller wheel 13. Upstream of the impeller wheel 13 are the inlet guide vanes 14 that also hold concentrically the segment of an inner casing 15.

The direction of the flow of gas, and the direction, in which the compressor augments the pressure of the gas, is shown by the arrows in the Figure.

The compressor is constructed as a module. In FIG. 1, a complete module is spanned by A, a next module downstream of A is indicated at B, and C is an inlet nose fairing to be fitted to a single module or to the first of a number of coupled modules. The cone D is a diffusing cone to be fitted at the exhaust of a module or at the exhaust of the last of a number of modules connected in tandem, i.e. one after the other in the direction of gas flow.

Figure 2:
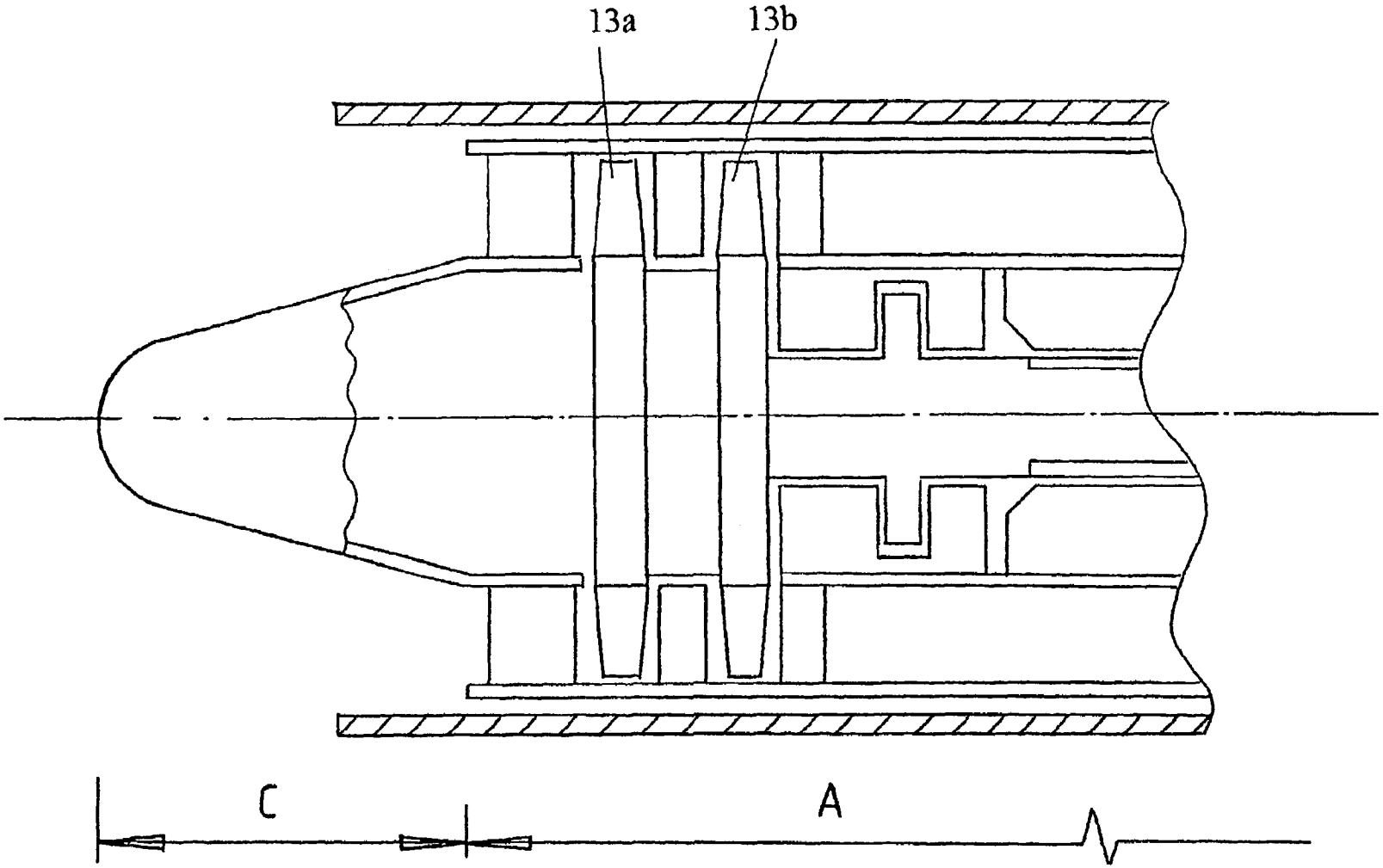
FIG. 2 is a detail of a second embodiment of the invention shown in axial section.

FIG. 2 shows a detail of a compressor module that differs from the module A of FIG. 1 in that it has two compressor stages, i.e. two bladed impeller wheels 13*a* and 13*b*. One or more stages may be provided in dependence upon the duty to be performed, the power of the motor, and what is found to be the design optimum in each application.

Gas bearings are used because of the speed of the compressor and because they can use as a lubricant a fluid already present, namely the produced gas. Gas bearings offer lower friction than water or oil lubricated bearings. Rolling element bearings would have too short a life expectancy under the onerous down well conditions.

Since the compressor(s) are likely to be mounted either vertically, or in a near vertical attitude, the journal bearings (designated 9 and 10 in FIG. 1) will react little load and hence will most likely be of a hydrostatic type. Such bearings rely on the injection of gas at high pressure to separate the contacting surfaces. This high pressure gas is provided by the auxiliary compressor once it has achieved a sufficiently high rotational speed.

The thrust bearing (designated 11 in FIG. 1) will carry continuous load and therefore will be of a hydrodynamic type achieving separation by a self-generated film once the shaft reaches a sufficiently high speed.

During start-up, it is anticipated that rubbing contact will occur in all the bearings until the shaft becomes self supporting on the gas films. Such starting will necessitate significant power to overcome friction and necessitates careful material selection and dimensional control.

The heat generated by the electrical losses of the motor is removed by passing the heat to the flow of gas, the produced gas being the sole cooling medium available.

Figure 3:
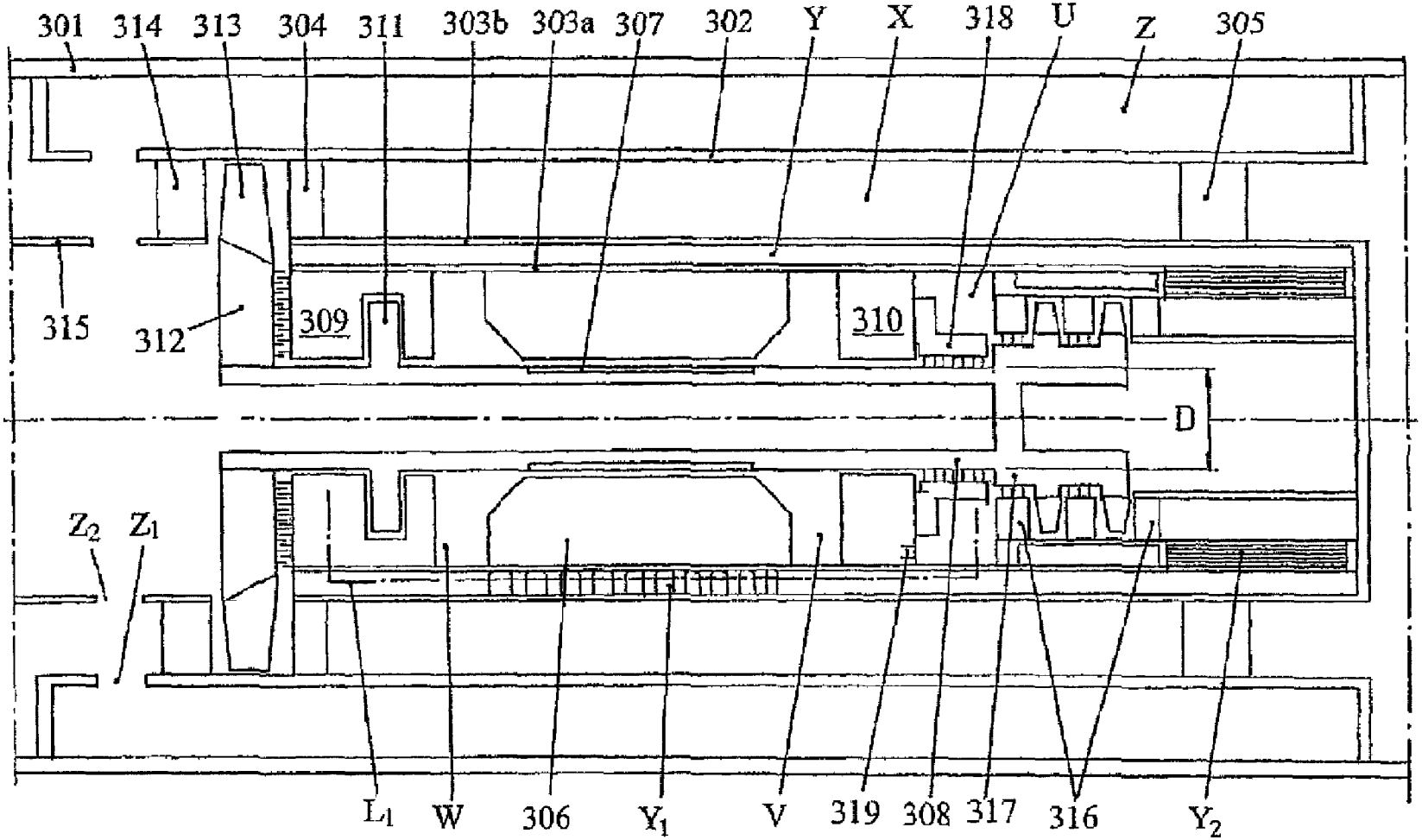
FIG. 3 is an axial section through a compressor in accordance with a third embodiment of the invention.

An embodiment of the invention that includes gas bearings is illustrated diagrammatically by FIG. 3. The Figure illustrates a version of the module that is designated A or B in FIG. 1.

In FIG. 3, the production tube of the well is designate 301, the outer shell of the compressor 302, while numerals 303*a* and 303*b* refers to a double casing of the motor. The casing of the motor is held concentrically within the shell of the compressor by stationary blades 304 of the compressor and by the arms of a spider 305. The stator of the motor is shown at 306 and its armature at 307.

The hollow rotor of the compressor, of which the armature of the motor is a part, is designated 308. The rotor runs in the journal bearings 309, 310, and thrust is taken by a thrust bearing having a collar 311.

The motor drives the wheel 312 of the dynamic compressor with its impeller blades 313. Upstream of the compressor are the inlet guide vanes 314 that also hold concentrically the segment of inner casing 315, and downstream at 304 are the fixed blades.

The compressor propels gas into the principal annular channel X that is the channel for the main flow of the produced gas, but also into an annular channel Y bounded by the walls 303*a* and 303*b* of the casing of the motor. Annular channel Z is formed by the space between the outer casing 302 of the compressor and the production tube 301. The channel Z is closed at each end by annular plates that fit as closely as is practicable into the bore of the production tube. The pressure in channel Z is maintained by ports Z1 substantially at the pressure upstream of the inlet guide vanes 314.

Similarly, the pressure over the face of the compressor wheel 312, and within the bore of the rotor, is maintained by ports Z2 substantially at the pressure upstream of the inlet guide vanes.

The gas that flows through channel Y flows over an extended heat transfer surface at Y1 that by welding, or other method of fixing, is in intimate thermal contact with the inner motor casing 303*a*. The gas flow through channel Y, and past the extended heat transfer surface, cools the stator 6 (within FIG. 1) of the motor.

The extended heat transfer surface may by way of example comprise a number of fins equally spaced around the circle and extending in a spiral around the inner casing of the motor or axially.

Downstream of the extended heat transfer surface the gas flows via a purifier Y2 into the inlet of the auxiliary dynamic compressor that is illustrated with two stages and is indicated as an assembly at 316.

The auxiliary compressor further compresses gas into the volume U that is bounded on the left-hand side in FIG. 3 by the journal bearing 310 and by the labyrinth gland 318 that is bolted to the bearing to ensure concentricity.

The pressurized gas enters the journal bearing 310 by such ports as may be convenient, for example the port shown at 319. The gas enters the journal and thrust bearing 309 from the volume U, for example via pipes L1 laid between adjacent fins of the extended heat transfer surface Y1 as shown in FIG. 6 in response of another embodiment of the invention. The flow path of the pipes L1 is represented in FIG. 3 by a chain-dotted line, which is also designated L1.

It is desirable to preserve thermal symmetry such as would be obtained by four pipes equally disposed around the circle.

The volumes V and W are in communication via the air gap between the bore of the stator of the motor and its armature and consequently the gas pressures in these volumes will be substantially equal. The volume V and the volume W or both are connected to channel Z by way of hollow spider arms that are not shown and that are necessary to hold concentrically the various casings. It is to be noted that because of through spaces such as the spaces between the pads, the pressures to the left and to the right of a bearing become equalized.

In the designation of gas pressures the flow pressure losses, and other effects that have a detailed influence upon pressure will not be taken in to consideration.

The pressures will be designated as:—

P1: the pressure of the gas upstream of the compressor module. By the connecting passages such as Z1 and Z2 it is also the pressure in the channel Z, and also the pressure acting upon the left hand face of the wheel 312, and within the bore of the rotor 308. Spaces V and W are also at pressure P1 by virtue of their connection with the channel Z via the hollow spider arms, P2: the pressure downstream of the stator blades 304 and the pressure in the channel X, P3: the pressure downstream of the inner part of the runner blades 313. This is the pressure in the channel Y, and the pressure at the inlet of the auxiliary compressor 316, and P4: the pressure downstream of the auxiliary compressor. P4 is also the pressure supplied to the bearings 309, 310 and 311.

In operation of the module, the inner part of the runner blades 313 together with the auxiliary compressor 316 raise the pressure of the gas from the pressure P1 via the pressure P3 to the pressure P4. Gas at pressure P4 flows to the bearings where in essence it is throttled in its escape in to the volumes V and W down to the pressure P1. In a similar fashion the gas leaking through the labyrinth seal 318 is throttled from the pressure P4 down to the pressure P1.

The axial forces that act upon the rotor during operation are:

a thrust force from right to left (as viewed in FIG. 3) generated by the wheel 312 and the runner blades 313 of the main compressor, a thrust force from left to right generated by the auxiliary compressor 316, the gravitational pull upon the rotor from right to left dependent upon the inclination of the module, and a force from left to right produced by the pressure difference across the balance piston 317.

The diameter D may be chosen in design so that the axial force produced at the balance piston 317 offsets as great a part as is practicable of the resultant of the other axial forces.

Figure 4:
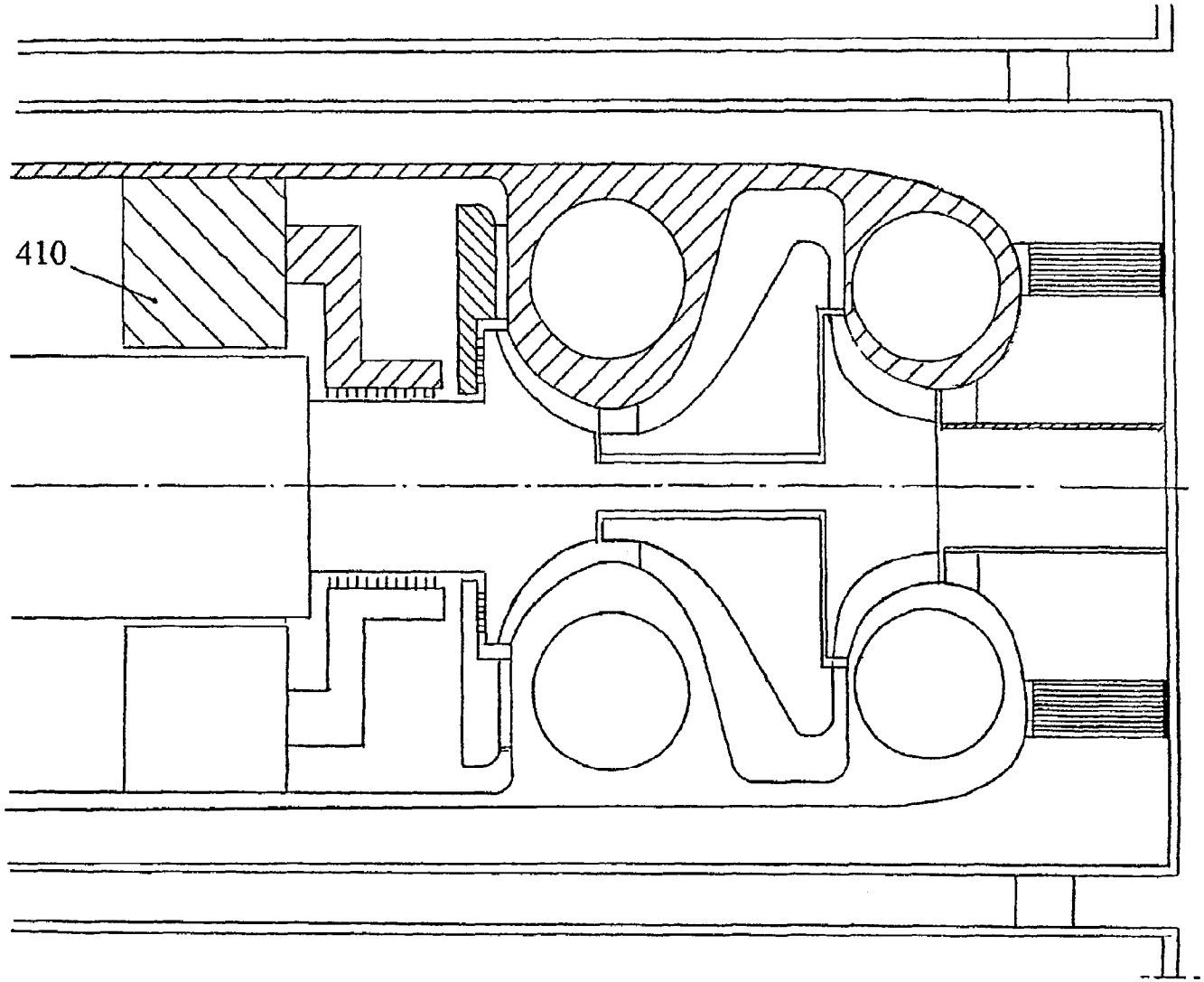
FIG. 4 is a detail of a fourth embodiment of the invention shown in axial section.

Another embodiment is illustrated in FIG. 4 that is a modified version of the embodiment of FIG. 3. To make the distinction between moving and stationary parts evident, the stationary parts are hatched in the upper part of the figure.

FIGS. 3 and 4 may be related one to the other by the element 410 that corresponds to the right hand journal bearing 310 of the compressor shown in FIG. 3. In the embodiment of FIG. 4, the auxiliary compressor to the right of the bearing is a two stage centrifugal compressor as opposed to the two stage axial compressor of the embodiment of FIG. 3.

With other things equal the pressure rise across a centrifugal and an axial flow compressor stage is set by the peripheral speed of the compressor disk, and by the mean peripheral speed of the runner blades of the axial flow stage.

When confined within the same diameter casing, an axial flow stage may have a greater mean diameter of its runner blades than the outer diameter of the centrifugal compressor disk because the centrifugal compressor requires a diffuser outboard of its disk, and the axial flow compressor does not. This consideration with relation to FIGS. 3 and 4 may lead to a single stage axial auxiliary compressor in the embodiment of FIG. 3 performing the same duty as the two stage centrifugal compressor of FIG. 4.

FIGS. 5*a* and 5*b* are idealized enthalpy-entropy diagrams for the gas flows compressed by the auxiliary compressors of the embodiments of FIGS. 3 and 4, and then throttled to their initial pressures in the bearings.

With reference to FIGS. 3 and 5*a*, the gas flows in to the module at pressure P1. Downstream of the running blades of the main compressor, in the channel Y, the gas is at pressure P3, and after passage through the auxiliary compressor it enters the bearings at pressure P4. The gas is then throttled down to the pressure P1 at its exhaust from the bearings.

Constant pressure lines for P1 and P4 are drawn in FIG. 5*a*. The inflow of gas occurs at 'a', the gas is compressed to 'b' and then throttled to its outflow at 'c'. The inflow is of relatively cool gas, and the outflow is gas heated by the energy input of compression over 'a' to 'b'.

Figure 6A:
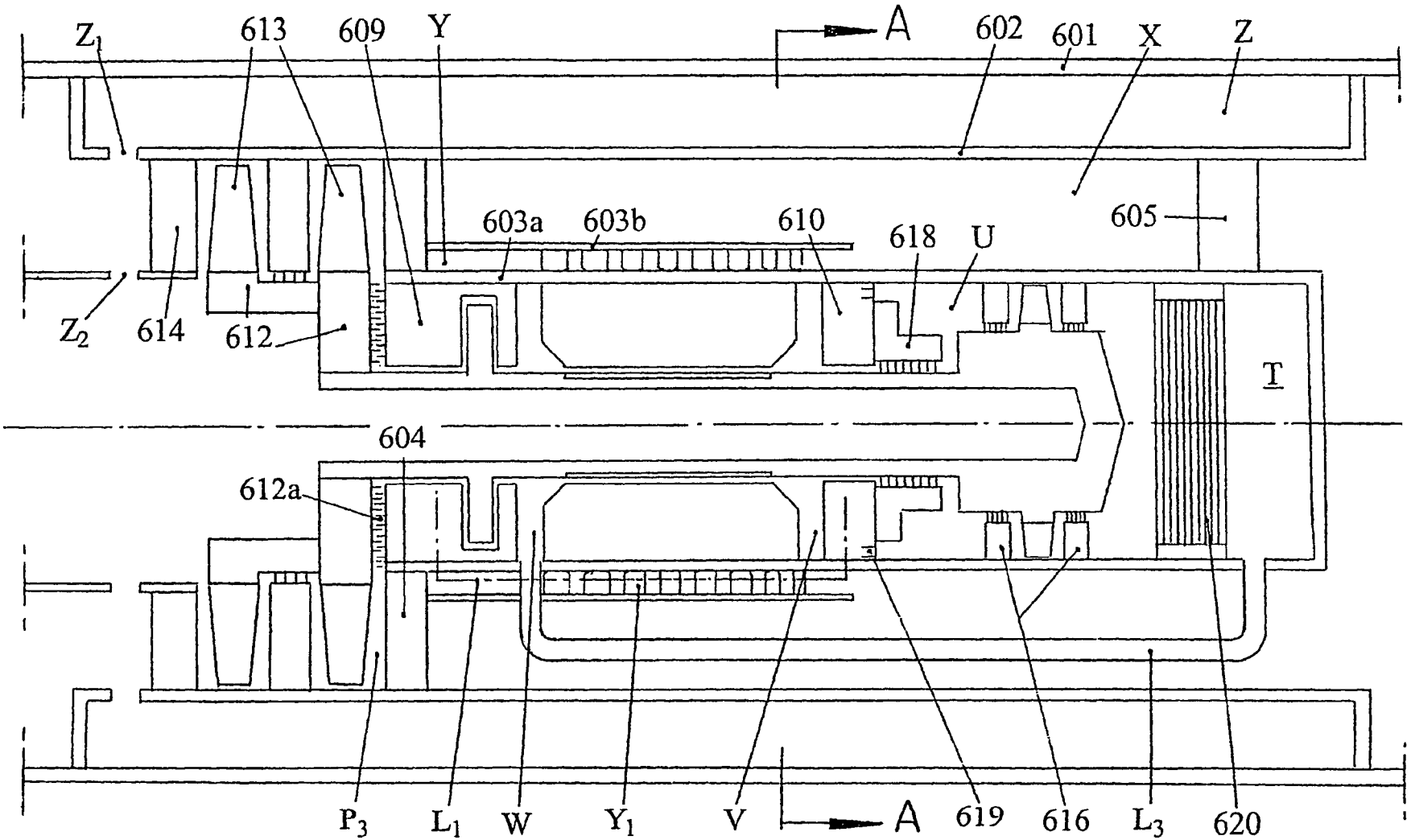
FIG. 6*a* is an axial section through a compressor in accordance with a further embodiment of the invention.

If provision is made by means of a heat exchanger to cool the same gas flow from 'c' to 'a' then the gas for the bearings would be a closed circuit. Once purified the same gas would be in continuous use. FIGS. 6*a* and 6*b* illustrate diagrammatically an embodiment in which such a closed circuit is provided for the high-pressure gas.

In the embodiment of FIG. 6*a* the main compressor is a two-stage axial flow compressor shown at 614, 613, 612 and 604. A cylindrical baffle 603*b* with the casing of the motor 603*a* form a channel Y in which gas flows over the cooling fins Y1 of the stator of the motor. Channel Y, and channel X become a single channel downstream of the baffle.

The closed circuit will be now described, taking the volume T as its starting point. Gas from T flows through the filter 620 in to the intake of the axial flow compressor 616. The compressor delivers high pressure gas in to the volume U and from there it passes via ports 619 to the journal bearing 610, and to the journal and thrust bearing at 609 via pipes of which one is at L1. The gas is throttled on passing through the bearings and exhausts in one instance first to the volume V, and then via the air gap of the motor to volume W where it joins the exhaust from the other bearing. The gas is returned to the volume T via pipes of which one is indicated at L3. Pipes L3 are laid in the channel X where the passing of the main flow of gas past them will cool the pipes and the circulating gas within them.

There is also a leakage flow of high-pressure gas from the volume U to the volume V via the labyrinth gland 618. This leakage through the labyrinth is a parallel path in which the gas is throttled down to the same lower pressure as the high pressure gas that is passed through a bearing.

The only connection of the closed circuit to the main gas flow is by leakage through the labyrinth gland 612*a*. This leakage will equalize the pressures either side of the labyrinth, and consequently the low pressure of the closed circuit will be the pressure P3 downstream of the second stage runner blades of the main compressor. FIG. 5*b* is the enthalpy-entropy diagram of the closed circuit.

With reference to FIG. 5*b*, the cooling of the gas from 'b' to 'c' depends upon the effectiveness of heat transfer across the tube L3. A balance has to be made between the energy input into the circulating gas by the auxiliary compressor, and the heat lost from the circulation through the walls of pipes L3 to the main gas stream. The balance is created through the temperature of the circulating gas. The gas loses more heat across the walls of the pipes L3 as the gas temperature rises, and at the same time the energy input in to the gas by the compressor falls. The gas of the closed circuit will be at the temperature at which heat loss and energy input are in balance. It is desirable that the temperature of the gas at the inlet of the auxiliary compressor should be brought as close as is practicable to the temperature of the flow in the channel X by optimizing the gas to gas heat transfer coefficient of the wall of pipes L3.

The flow of gas into or out of the closed circuit through the labyrinth 612*a* is so minimal that the danger recedes of the bearings becoming damaged by particulate matter. It is likely that any particulate matter originally borne by gas entering the closed circuit via the labyrinth 612*a* will have previously been centrifuged by virtue of the whirl component imparted to the gas by the bladed impeller wheel.

The flow resistance in the combined channels X and Y is increased by the intrusion of pipes and fins in to the flow area. For that reason, the main compressor 604, 612, 613, 614 has been changed for illustrative purposes from the compressor of FIG. 3 to a two-stage compressor. Whether such a change is needed can only be determined in each particular instance from a design study.

The auxiliary compressor 616 of FIG. 6*a* is a single stage compressor in comparison with the two stage auxiliary compressor of FIG. 3.

The section A-A of FIG. 6*a* outboard of the motor casing is illustrated in FIG. 6*b*. The cooling fins of the stator are at Y1 between the casing of the motor 603*a* and the baffle 603*b*. The four pipes L1 run between adjacent fins. Eight pipes L3 are illustrated equally spaced around the circle in the channel X. The pipes L3 may conveniently be formed as an extrusion with both internal and external fins to enhance the gas to gas heat transfer.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A compressor designed to be lowered into a well of a natural gas reservoir to assist in extracting gas from the reservoir, the compressor comprising:

at least one casing;

at least one rotor mounted within the casing;

at least one electric motor for driving the rotor;

one or more gas bearings supporting the rotor for rotation relative to the casing, the gas bearings being arranged at an upstream end and a downstream end thereby arranged at opposite ends of the motor;

at least one bladed impeller wheel for compressing a production of gas from a reservoir which is mounted on an overhanging end of the rotor that projects beyond each of the gas bearings at the upstream end of the motor;

at least one auxiliary compressor mounted on the downstream end of the rotor so that the auxiliary compressor draws from down stream the bladed impeller wheel and pressurizes the gas before supplying the gas to the bearings of the rotor;

wherein all the gas bearings of the auxiliary compressor and of the electric motor are arranged on a same side of the bladed impeller wheel; and during operation, the gas flows over to cool the electric motor.

2. The compressor of claim 1, wherein the rotor is formed hollow to assist in cooling of the motor.

3. The compressor system of claim 1, further comprising at least one additional auxiliary compressor arranged in tandem with the auxiliary compressor.

4. The compressor of claim 1, wherein the the casing includes a channel formed therein which runs parallel to the rotor between an output of the auxiliary compressor mounted at the downstream end of the rotor up and the upstream end of the rotor for supplying the gas to the bearings of the rotor.

5. The compressor of claim 4, wherein the auxiliary compressor is also an axial compressor.

6. The compressor of claim 4, wherein the auxiliary compressor is a centrifugal compressor.

7. The compressor of claim 4, further comprising:

a purifier is provided in an intake of the auxiliary compressor.

8. The compressor system of claim 4, further comprising at least one additional auxiliary compressor arranged in tandem with the auxiliary compressor.

9. The compressor of claim 4, wherein the gas pressurized by the auxiliary compressor is discharged into an axial flow of produced gas after passing through the bearings.

10. The compressor of claim 9, further comprising:

means for transferring heat from the gas discharged from the bearings to the axial flow of the gas and for recycling a cooled gas to an intake of the auxiliary compressor, whereby the gas supply to the bearings flows through a substantially closed circuit.

11. The compressor of claim 4, wherein both the main compressor and the auxiliary compressor are overhung with all the bearings being situated axially between the main compressor and the auxiliary compressor.

12. The compressor of claim 11, wherein the auxiliary compressor is also an axial compressor.

13. The compressor system of claim 12, further comprising at least one additional auxiliary compressor arranged in tandem with the auxiliary compressor.

14. The compressor of claim 11, wherein the auxiliary compressor is a centrifugal compressor.

15. The compressor of claim 14, further comprising:

a purifier is provided in an intake of the auxiliary compressor.

16. The compressor of claim 15, wherein the gas pressurized by the auxiliary compressor is discharged into an axial flow of produced gas after passing through the bearings.

17. The compressor of claim 16, further comprising:

means for transferring heat from the gas discharged from the bearings to the axial flow of the gas and for recycling a cooled gas to an intake of the auxiliary compressor, whereby the gas supply to the bearings flows through an essentially substantially closed circuit.

18. The compressor system of claim 17, further comprising at least one additional auxiliary compressor arranged in tandem with the auxiliary compressor.

19. The compressor system of claim 17, further comprising:

a plurality of auxiliary compressors arranged in tandem position at different heights along a bore hole of a well.

20. A downhole compressor comprising:

at least one rotor with at least a downstream gas bearing and an upstream gas bearing mounted thereon;

at least one casing for supporting the downstream gas bearing and an upstream gas bearing of the rotor so as to permit rotation of the rotor relative to the casing, wherein the casing includes a channel formed therein which runs parallel to the rotor between and the downstream gas bearing and the upstream gas bearing;

at least one overhanging bladed impeller wheel for compressing a gas, the overhanging bladed impeller wheel mounted on an upstream end of the rotor that projects beyond all the upstream gas bearing;

at least one auxiliary compressor mounted for further compressing the gas, the auxiliary compressor mounted on a downstream end of the rotor that projects beyond all the downstream gas bearing;

at least one electric motor disposed on the rotor between the upstream gas bearing and the gas downstream, whereby the motor and the downstream gas bearing and the upstream gas bearing are all situated in between the overhanging bladed impeller wheel and the auxiliary compressor so that the gas flows from the overhanging bladed impeller wheel to cool the electric motor and afterwards at least a portion of the gas flows through the auxiliary compressor into the channel in the casing in a direction towards the upstream end of the rotor to supply the gas to the upstream gas bearing and the downstream gas bearing.

* * * * *